US005474095A

United States Patent [19]

Allen et al.

[11] Patent Number: 5,474,095

[45] Date of Patent: Dec. 12, 1995

[54] PAPER HAVING CROSSDIRECTIONAL REGIONS OF VARIABLE BASIS WEIGHT

[75] Inventors: Jeffery L. Allen, Midlothian; Gordon H. Bokelman, Chesterfield; Navin Gautam, Richmond, all of Va.; David J. Kraske, Orrington, Me.; James L. Myracle, Jr., Midlothian, Va.; Robert M. Rogers, Jr.; Edward B. Sanders, both of Richmond, Va.

[73] Assignee: Philip Morris Incorporated, New York, N.Y.

[21] Appl. No.: 224,086

[22] Filed: Apr. 6, 1994

Related U.S. Application Data

[63] Continuation of Ser. No. 614,620, Nov. 16, 1990, abandoned.

[51] Int. Cl.[6] ..... A24D 1/02

[52] U.S. Cl. ..... 131/365; 162/125

[58] Field of Search ..... 131/365; 162/116, 162/125, 129

[56] References Cited

U.S. PATENT DOCUMENTS

| | | | |
|---|---|---|---|
| 1,555,320 | 9/1925 | Weil . | |
| 1,847,269 | 3/1929 | Schur . | |
| 1,903,236 | 3/1933 | Johnsen . | |
| 1,996,002 | 3/1935 | Seaman . | |
| 1,999,222 | 4/1935 | Weinberger . | |
| 2,013,508 | 9/1935 | Seaman . | |
| 2,049,320 | 7/1936 | Ruben et al. . | |
| 2,666,437 | 1/1954 | Lattof . | |
| 3,477,440 | 11/1969 | Licis | 131/365 |
| 3,560,334 | 2/1971 | Arledter . | |
| 3,632,384 | 1/1972 | Saint-Pastou . | |
| 3,633,589 | 1/1972 | Kahane et al. . | |
| 3,915,176 | 10/1975 | Heitmann et al. | 131/84.4 |
| 4,153,503 | 5/1979 | Booth et al. . | |
| 4,239,591 | 12/1980 | Blake . | |
| 4,489,738 | 12/1984 | Simon . | |
| 4,739,775 | 4/1988 | Hampl, Jr. . | |
| 4,928,715 | 5/1990 | Mentzel et al. . | |
| 4,945,932 | 8/1990 | Mentzel et al. . | |
| 4,987,940 | 1/1991 | Straub et al. . | |
| 5,028,224 | 7/1991 | Pieper et al. . | |

FOREIGN PATENT DOCUMENTS

| | | | |
|---|---|---|---|
| 0139934 | 5/1985 | European Pat. Off. . | |
| 0262550 | 4/1988 | European Pat. Off. . | |
| 0407022 | 1/1991 | European Pat. Off. . | |
| 0615090 | 1/1980 | Switzerland | 131/365 |
| 1235692 | 6/1971 | United Kingdom . | |

OTHER PUBLICATIONS

Casey, *Pulp and Paper Chemistry and Chemical Technology,* vol. III, 3rd Edition, pp. 1751–1756, 1981.

*Primary Examiner*—Jennifer Bahr

*Attorney, Agent, or Firm*—Charles E. B. Glenn; James E. Schardt; Kevin B. Osborne

[57] ABSTRACT

This invention refers to a paper having crossdirectional regions having increased basis weight. The paper of this invention is especially useful as a wrapping material for a smoking article. The paper may be produced by depositing additional material onto a moving base web in a papermaking machine. The additional material is deposited by means of a rotating drum containing a plurality of slits through which the additional material passes.

42 Claims, 3 Drawing Sheets

PAPER HAVING CROSSDIRECTIONAL REGIONS OF VARIABLE BASIS WEIGHT

This is a continuation of application(s) Ser. No. 07/614,620 filed on Nov. 16, 1990, now abandoned.

BACKGROUND OF THE INVENTION

This invention relates to paper and its production. More specifically, this invention relates to a nonlaminated paper of variable basis weight. In a preferred embodiment of the present invention, the paper described herein possesses regions of increased basis weight. These regions of increased basis weight are crossdirectional, i.e., they are oriented substantially parallel to the crossdirection of the paper and orthogonal to the machine direction of the paper. As used herein, basis weight is meant the weight of the paper per unit surface area, and is expressed in grams per square meter.

Paper such as that described herein is particularly useful as a wrapping material for smoking articles, although other uses are within the scope of this invention. For example, the paper of this invention has applications in banking, industrial, and household uses.

In the papermaking art, it is often customary to produce paper whose basis weight is as uniform as possible. Sheets of paper produced during standard papermaking processes are, therefore, usually of uniform basis weight when the paper is considered as a whole. Microscopic variations in the basis weight of the paper do nonetheless occur because of variations in the size of the constituent fibers or fluctuations in the manufacturing process.

Paper used in the tobacco industry as cigarette wrapping material has commonly been of uniform basis weight to promote even burn characteristics in the smoking article. It is now desirable to produce a cigarette wrapping paper which imparts special burn characteristics, e.g., the paper promotes a decrease in the static burn rate of the smoking article to the point that combustion of the article is decreased, substantially negligible, or terminates altogether. Such a wrapping paper, as described herein, possesses a plurality of crossdirectional regions of increased basis weight.

There have been attempts to produce nonlaminated paper of increased thickness. For example, Blake U.S. Pat. No. 4,239,591 refers to the production of paper having either islands or continuous regions of increased thickness. One drawback of this invention is that the regions of increased thickness run in the direction that the web is laid down.

There have been attempts to produce wrappers for smoking articles designed to reduce the Burn Mode Index in a laminated portion thereof. For example, Hampl U.S. Pat. No. 4,739,775 refers to wrappers which have bands laminated to cigarette paper.

Mentzel et al. U.S. Pat. No. 4,945,932 refers to a cigarette of reduced combustion proclivity having batonned paper.

There have been attempts to decrease the burn rate of wrapping materials for smoking articles. These attempts involve incorporating into the wrapping material a burn retardant such as magnesium acetate. These burn retardants can contribute undesirable flavors to the smoking article upon combustion.

It would be desirable to provide a nonlaminated paper having a plurality of crossdirectional regions of increased basis weight.

It would further be desirable to provide a paper which is useful as a wrapping material that alters the puff count of a smoking article.

It would be desirable to reduce the amounts of burn retardants used in wrapping materials for a smoking article.

It would also be desirable to provide paper useful as a wrapping material for a smoking article which permits increased use of expanded tobacco.

It would be further desirable to provide a method for producing non-laminated paper having regions of variable basis weight in the crossdirection.

It would also be desirable to provide a method for producing paper which allows a wide variety of materials to be laid down in the crossdirection of the paper.

SUMMARY OF THE INVENTION

It is an object of this invention to provide a nonlaminated paper having a plurality of regions of increased basis weight in the crossdirection.

It is also an object of this invention to provide a paper which is useful as a wrapping material for a smoking article which alters the puff count of a smoking article.

It is a further object of this invention to reduce the amounts of burn retardants used in wrapping materials for a smoking article.

It is an additional object of this invention to provide a paper which is useful as a wrapping material for a smoking article which permits the increased use of expanded tobacco.

It is a further object of this invention to provide a method for producing paper having a plurality of regions of variable basis weight in the cross direction.

It is also an object of this invention to provide a method of paper production which allows a variety of materials to be laid down in the crossdirection of the paper.

These and other objects are accomplished in accordance with the present invention by providing a paper comprising a base web having a plurality of crossdirectional regions of increased basis weight, whereby the paper promotes a decrease in the static burn rate of the smoking article.

The paper of this invention, once incorporated into a smoking article, promotes an overall decrease in the static burn rate of the smoking article. The paper of this invention may be produced by depositing additional material, such as pulp stock, onto a base web of pulp of generally uniform thickness in the web-forming area of a paper machine in either wet or dry methods of paper production. The additional stock may be deposited onto the base web by means of a rotating drum having a plurality of longitudinal slits through which the pulp passes.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
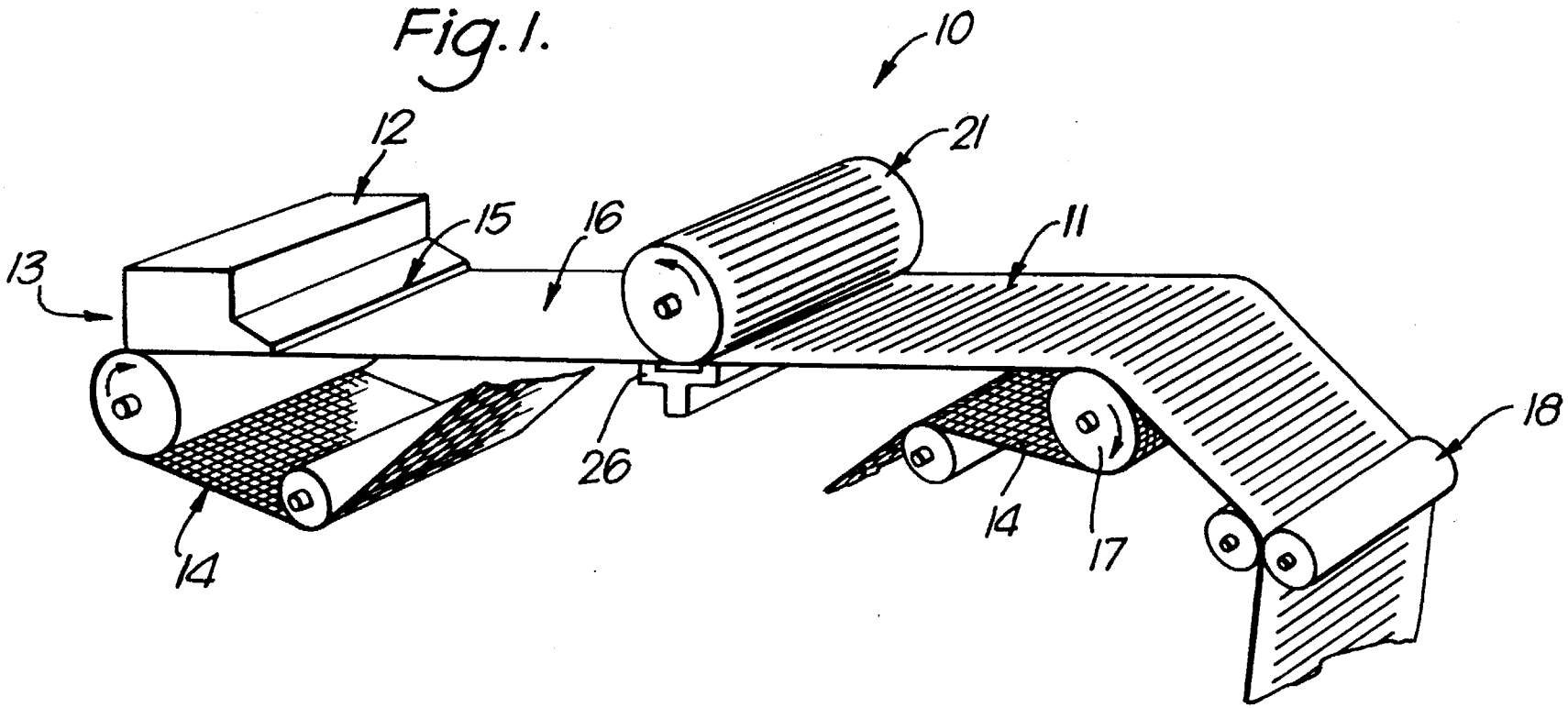
FIG. 1 depicts a simplified schematic illustration of a portion of a papermaking line, from a point from the headbox to the press section of a Fourdrinier papermaking machine.

The present invention relates to a nonlaminated paper of variable basis weight. The paper of this invention possesses crossdirectional regions having a basis weight different from that of the base web. In a preferred embodiment, the crossdirectional regions have a basis weight greater than the basis weight of the base web. As used herein, "paper" is the paper of this invention, "base web" is the portion of the paper without the regions of increased basis weight, and "crossdirectional regions" are the regions of variable basis weight in the crossdirection.

An increase in basis weight may be achieved by providing a paper with localized regions with either (1) increased thickness and/or (2) increased density. The increase in basis weight may be accomplished by depositing, onto an existing pulp web in a papermaking machine, additional material such as a second quantity of pulp or, alternatively, a filler material. Some examples of additional materials are highly refined pulp, high surface area cellulosic fibers, microcrystalline cellulose or a mixture of highly refined pulp and calcium carbonate. Additional material may also include materials that confer distinctive qualities upon the paper, such as compounds which are detectable by electromagnetic means, inks, dyes and the like. Hereinafter the additional materials are referred to as "material."

The paper of this invention may be produced from any lignocellulosic pulp, such as softwood or hardwood pulp. Preferably, however, the pulp is cellulosic pulp, and more preferably, the pulp is derived from non-wood plants such as grasses. Most preferably, the pulp is flax pulp.

While paper commonly used to overwrap smoking articles has a basis weight of about 20–30 g/m$^2$ the paper of this invention has an average basis weight of about 25–70 g/m$^2$. The cross-directional regions preferably have a basis weight above that of the base web. More preferably, the crossdirectional regions have an increase in basis weight up to about 100% above that of the basis weight of the base web. Most preferably, the crossdirectional regions have an increase in basis weight about 0.01–30% above that of the base web.

The crossdirectional regions, although they possess increased basis weight, are preferably of substantially the same thickness as the base web. The paper of this invention, therefore, is of substantially uniform thickness when viewed as a whole. Preferably, the base web has a thickness of about 0.0010–0.004 inches. The crossdirectional regions have a thickness amounting to no more than about 50% greater than the thickness of the base web. More preferably, the crossdirectional regions have a thickness of no more than about 10% greater than that of the base web.

The paper of the present invention, once incorporated into a smoking article, is capable of promoting uneven burn characteristics, e.g., the static burn rate of the smoking article decreases to the point that combustion of the article is substantially negligible or terminates altogether. The porosity of the paper wrapping of a smoking article plays a major role in altering the static burn rate of the smoking article. While not wishing to be bound by theory, it is believed that oxygen must diffuse through the paper to the burning tobacco to support combustion; when oxygen has difficulty passing through the paper, the rate of combustion decreases. Combustion, the interaction of tobacco with oxygen to produce heat and light, is flameless and glowing.

For example, the porosity of the wrapping materials normally found in smoking articles such as cigarettes is about 25–60 Coresta. Wrapping materials such as these, of which the base web is a member, result in a smoking article which has a static burn rate of about 6–10 min for a segment 40 mm in length. The crossdirectional regions of the present invention, however, have a porosity of up to about 10 Coresta, resulting in a static burn time of about 10–20 min in a banded region 40 mm in length. If desired, the porosity of either the base web or the regions may be altered by conventional methods such as electrostatic perforation.

As stated above, the paper of this invention, once incorporated into a smoking article, may also promote self-extinguishment of the smoking article. For example, a conventional cigarette will smolder without extinguishment until all combustible material has been consumed. A smoking article made from the paper of this invention will smolder for about 0.5–4 minutes before extinguishing. Those skilled in the art will understand that the time before a smoking article made from the paper of this invention self-extinguishes will depend upon the width of the crossdirectional regions, the porosity of the base web and the crossdirectional regions, the spacing between bands and any burn additives used. The time-to-extinguishment, therefore, may be determined and manipulated by simple experimentation with these parameters.

The dimensions of the crossdirectional regions will also affect the burn characteristics of the paper and, consequently, the smoking article. In particular, the width of the crossdirectional regions exerts a greater effect on the burn rate than the length. Preferably, the crossdirectional regions have a width of about 1–10 mm (more preferably 3–7 mm). Most preferably, the crossdirectional regions are of about 5 mm. The length of the crossdirectional regions should be substantially the same as the circumference of a smoking article such as a cigarette.

In a separate embodiment of the present invention, the crossdirectional regions may be of various regular and irregular geometric forms, shapes, and sizes. Furthermore, the crossdirectional regions may be either contiguous or non-contiguous. As used herein, "contiguous" is meant to include a single, uninterrupted crossdirectional region of increased basis weight, and "non-contiguous" is meant to include a divided area of increased basis weight so that a plurality of separate sections in the crossdirection results.

The distance between the crossdirectional regions will also affect the burn rate. For example, the greater the separation between crossdirectional regions, the faster a smoking article made from the paper will burn. The crossdirectional regions should be disposed equidistant to each other, although nonuniform spacing between the crossdirectional regions is contemplated by this invention. Preferably, the crossdirectional regions are positioned about 5–40 mm (more preferably about 15–30 mm) apart, measured center-to-center of the crossdirectional regions. Most preferably, the crossdirectional regions are about 21 mm apart.

The paper of this invention may also contain about 0–1% (preferably about 0.6%) by weight monoammonium phosphate. This chemical tends to reduce unattractive streaking of the paper due to condensation on the inside of the paper following puffs. The tendency of the paper to streak in this manner is increased because the overall porosity of the paper has been reduced. Monoammonium phosphate is used to eliminate this cosmetic problem.

To held control the puff count of the smoking article, the paper may additionally contain up to about 14% by weight of a burn chemical such as succinate, citrate, or any other alkali metal burn chemical known to those in the industry. The preferred burn chemical additive is about 0.001–0.99% by weight citrate The paper may further include about 0–1%, (preferably about 0.3%) sodium carboxymethylcellulose. This chemical, which acts as a film former, contributes to the imperviousness of the ash, which helps to reduce the sidestream smoke. Sodium carboxymethylcellulose is also believed to act as a carrying agent to help get the burning agent (e.g., citrate) into the paper.

In addition, the paper is made with a loading of about 25–40% by weight, preferably about 30%, of an inorganic filler such as calcium carbonate. Those skilled in the art will recognize that any inorganic filler may be used that results in a paper with the desired combustion parameters and which does not impart undesirable subjective qualities to the paper. When calcium carbonate is used, it may have a surface area of about 7–80 square meters per gram by the well-known BET method (see, for example, F. M. Nelson et al., "Determination of Surface Area" Analytical Chemistry, Vol. 30, No. 8, August 1958, pp. 1387–90, for a description of the BET method).

A first preferred embodiment the apparatus for producing the paper of this invention employs a daubing dandy machine which is described below. FIG. 1 depicts the pulp web-forming area of a conventional Fourdrinier papermaking machine 10, adapted to produce a continuous pulp web 16. A headbox 12 is adapted to contain a quantity of cellulosic pulp which is supplied to headbox 12 by a plurality of conduits 13 which communicate with a pulp source (not shown). A common pulp source is a pulp storage tank, which is not shown.*

*The pulp employed to make the paper of this invention is preferably of extremely low consistency— for example, less than about 0.5% fiber solids.

Placed immediately below headbox 12 is an endless forming wire 14. A slice 15 defined in a lower portion of headbox 12 adjacent to wire 14 permits the pulp from the headbox to flow through slice 15 onto the top surface of the wire 14 to form pulp web 16. Slice 15 is usually of narrow vertical width in order to regulate the amount of pulp which flows from headbox 12. The length of slice 15 typically may extend substantially the entire width of pulp web 16.

The top portion of wire 14 is adapted to move forwardly toward a couch roll 17 and away from slice 15. The direction from headbox 12 toward couch roll 17 is the downstream direction. Once pulp web 16 has been formed, it passes an applicator means 20 which deposits additional material onto pulp web 16. As wire 14 begins to move downwardly about couch roll 17 and back toward headbox 12, pulp web 16 is delivered from wire 14 to a plurality of press rolls 18 and then to a dryer section of papermaking machine 10. As pulp web 16 advances in the downstream direction, excess water is permitted to pass through wire 14. A vacuum typically may be applied to at least a portion of the underside of wire 14 to assist in the removal of water from pulp web 16. Couch roll 17 may be adapted to provide a vacuum through wire 14 to the underside of pulp web 16 to remove additional water.

Figure 2:
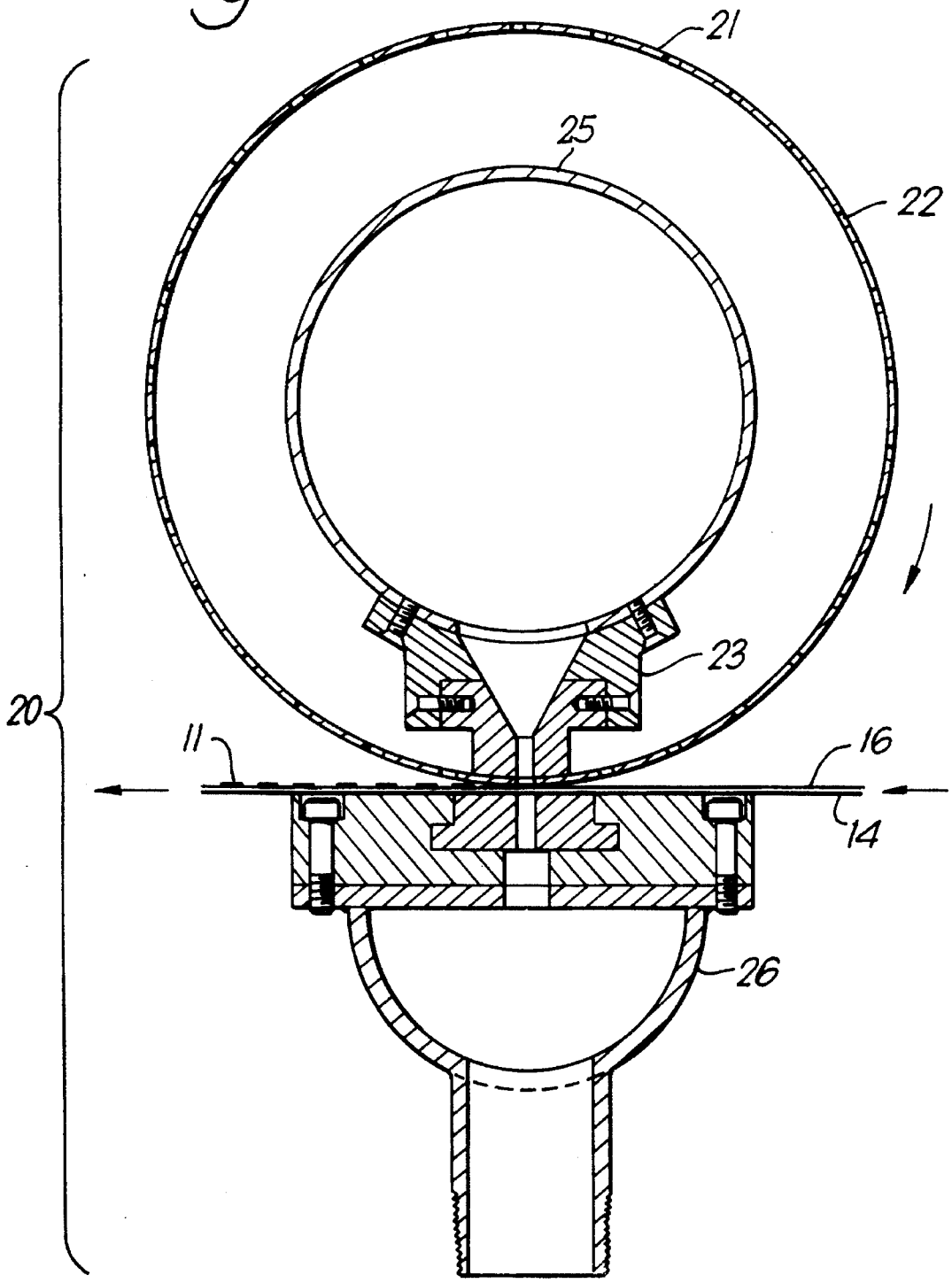
FIG. 2 depicts an end-on view of the applicator means which deposits additional material.

FIG. 2 depicts the applicator means 20 of the first preferred embodiment of the apparatus of the present invention which deposits the additional material onto pulp web 16. In this embodiment of the present invention, applicator means 20 comprises a hollow rotating drum 21. Rotating drum 21 typically includes a plurality of longitudinal slits 22. In a second preferred embodiment of the apparatus of the present invention, to be discussed below drum possesses a plurality of troughs (not shown) instead of longitudinal slits 22. In either preferred embodiment, each of slits 22 or troughs is oriented parallel to the longitudinal axis of drum 21. The number of slits 22 or troughs positioned about the drum will of course depend upon the radius of the drum.

Drum 21 is placed in contact with pulp web 16 following formation of web 16 on wire 14. Alternatively, drum 21 is not in physical contact with pulp web 16, but is proximally located so that pulp can stream directly from drum 21 to pulp web 16. Preferably, the velocity of both drum 21 and pulp web 16 are substantially synchronized, such that the angular velocity of drum 21 is approximately the same as the linear velocity of pulp web 16. If drum 21 is not physically contacting pulp web 16, the velocities of drum 21 and the pulp web need not be identical. The point at which the material is applied is preferably at or beyond the point at which the base web has consolidated.

While drum 21 is depicted as having both ends open, one or both ends may be entirely or partially closed. Drum 21 typically is supported by rollers protruding from the ends of drum 21. The supporting rollers may, in turn, be supported by a frame. Preferably, the frame can be lowered so that the drum is proximally located to pulp web 16 or can contact pulp web 16.

Drum 21 may be rotated by any desired means. In one embodiment, drum 21 frictionally engages pulp web 16, thereby achieving synchronized velocities of both drum 21 and pulp web 16. Alternatively, the drum 21 is rotated by an external drive mechanism. Suitable drive mechanisms are belts, gear trains, and the like. One of ordinary skill in the art may make a selection among the means for rotating a cylindrical body without departing from the scope of this invention.

As stated above, rotating drum 21 may possess a plurality of slits 22 or troughs. Slits 22 preferably are disposed equidistant to each other about drum 21, although nonuniform spacing between slits is contemplated by this invention. Preferably, slits 22 are positioned about 5–40 mm apart, measured from the center of one slit to the center of a slit immediately adjacent to it (center-to-center). More preferably, slits 22 are about 15–30 mm apart and, most preferably, about 21 mm apart.

Those of skill in the art will understand that the size and shape of the crossdirectional regions of increased basis weight will be determined by the shape and dimensions of slits 22. While slits 22 are preferably rectangular in shape, a selection may be made among various regular and irregular geometric shapes and forms without departing from the scope of the invention. Additionally, the crossdirectional regions may themselves be contiguous or non-contiguous in the crossdirection. Preferably, each of slits 22 has substantially the same dimensions. More preferably, each of slits 22 has dimensions of about 1–10 mm (more preferably about 1.5–5 mm) in width. Most preferably, the slits are about 2.5 mm wide.

Preferably, the length of the slits is at least substantially the same as the circumference of a smoking article, such as a cigarette. The practitioner, however, may make a selection among various slit lengths without departing from the scope of the invention. For example, the slit length may be greater than the circumference of a cigarette, in which case the practitioner may find it desirable to cut the resulting paper into a particular width. Alternatively, the slits may have a length of less than the circumference of a smoking article.

Each of slits 22 acts as a conduit through which material is deposited upon pulp web 16, thereby creating elongated areas of additional material which will become the regions. Preferably, the flow of material is regulated so that material does not emanate from more than a single slit 22 at a given time.

Pulp is conducted to the slits in the following manner. A cylinder 25 transports material from a pulp source to a stationary shoe 23. Stationary shoe 23 transfers the material, through an aperture 24, to the interior surface of drum 21. The interior surface of drum 21 is in complementary contact with a stationary shoe 23, out of which material flows. Such a complementary contact is achieved by having the area of contact between drum 21 and stationary shoe 23 concentric with the radius of curvature, and in contact with the interior of drum 21. Preferably, the distance between stationary shoe 23—drum 21 contact area and the drum 21—pulp web 16 contact area is minimized.

Stationary shoe 23 is elongated and has approximately the same length as drum 21. Stationary shoe 23 contains an elongated aperture 24 that extends at least a portion of the length of stationary shoe 23. In addition, aperture 24 is capable of discharging a substantially nonvariable amount of material at any point along aperture 24. Aperture 24 preferably has approximately the same dimensions as each of slits 22 in rotating drum 21.

Figure 3:
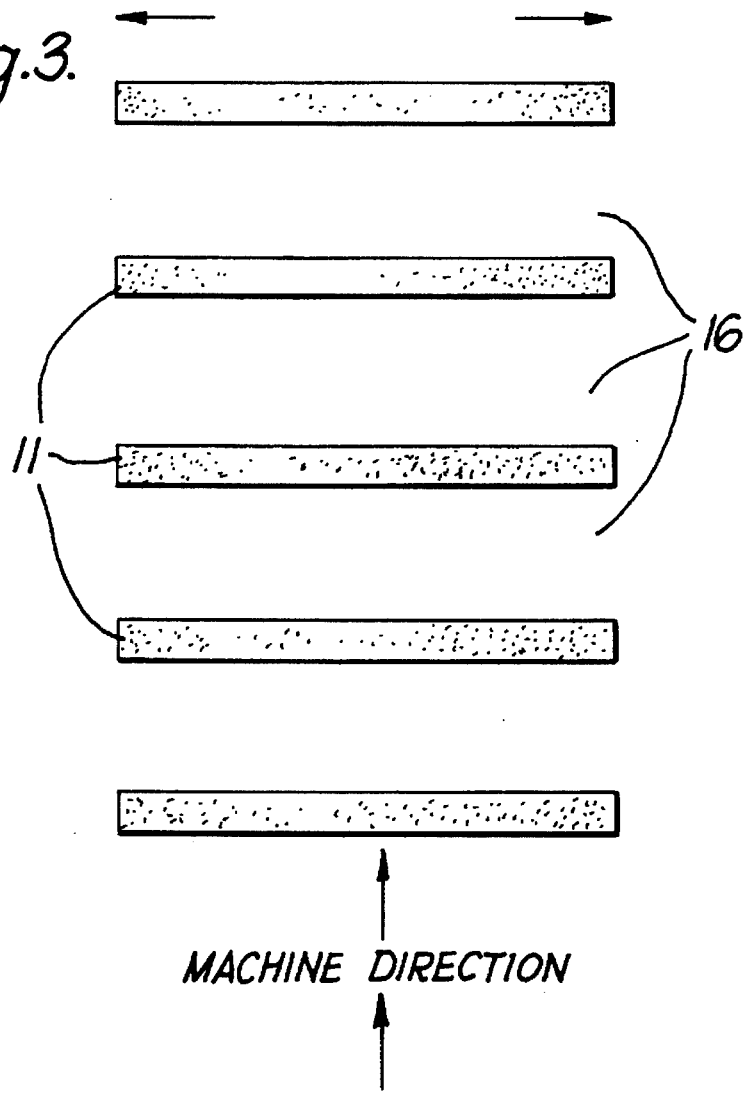
FIG. 3 depicts a paper sample having a plurality of regions of increased basis weight.

The rotation of drum 21 acts as a switch to interrupt the flow of material. The flow of material is interrupted by contact of stationary shoe 23 with the interior surface of drum 21 itself, and permitted when aperture 24 is aligned with slits 22. Thus, the rotation of drum 21 allows a plurality of crossdirectional regions 11 to be laid down on moving pulp web 16. As shown in FIG. 3, the transfer of material from slits 22 to pulp web 16 may be assisted by vacuum applied by vacuum box 26 through wire 14 or by pressurized gas applied through slits 22.

In the second embodiment of the apparatus of the present invention, a rotogravure-like process is employed to deposit additional amounts of material on the base web in the crossdirection. In this embodiment, rotating drum 21 contains a plurality of troughs (not shown in FIG. 2). The troughs are oriented parallel to the longitudinal axis of drum 21. An amount of material substantially the same as the volume of the troughs is placed in each of the troughs by means of a distribution header and metered by means of a doctor blade.

Once one or more troughs have been filled with material, drum 21 is rotated as previously described. Upon contact of a material-laden trough with base web 16, the material is transferred from the troughs to pulp web 16. The transfer of material from the troughs to pulp web 16 may be assisted by vacuum applied by a vacuum box 26 through wire 14 or by pressurized gas applied through the troughs.

The volume of additional material deposited will of course be determined by the volume of the troughs. Preferably, the troughs have the dimensions of between about 1–10 mm in width by less than about 3 mm in depth. The length of the troughs should be at a minimum substantially the same as the circumference of a smoking article, such as a cigarette.

Once the additional material has been deposited by either the daubing dandy or rotogravure methods, pulp web 16 with the regions 11 may be pressed by a roller means located downstream from the rotating drum. Preferably, pulp web 16 is pressed on press rolls 18. The pressure employed in the press rolls is comparable to that commonly used for pressing cellulosic pulp web, about 250 pounds per linear inch of the press rolls. In addition to sheet consolidation, water is removed from the sheet by the press rolls.

In a third embodiment of the apparatus of the present invention, a second headbox may be used to deposit additional material directly onto pulp web 16 or on a top wire that contacts the top of pulp web 16 instead of applicator means 20 depicted in FIGS. 1 and 2. The slice of the headbox, when open, deposits additional material onto pulp web 16 or onto the top wire. When the slice of the second headbox is closed, additional material cannot flow out of the second headbox. The practitioner may control the rate of opening and closing of the slice on the second headbox to construct regions in the cross direction of the desired dimensions.

Although the daubing dandy or rotogravure-type methods discussed above are preferred to produce the paper of this invention, other embodiments involving transfer rolls, a four-roll size press or crepeing devices may also be used. The transfer roll method contemplates applying bands at the press roll, the four roll size press contemplates applying bands at the size press, and crepeing contemplates applying microcrepes in normal cigarette paper.

Figure 4:
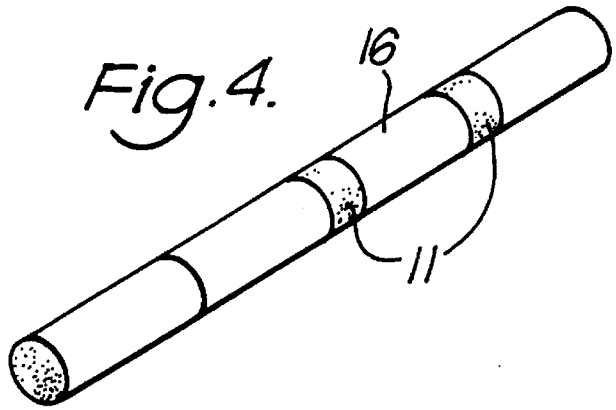
FIG. 4 depicts a simplified illustration of a smoking article incorporating the paper of the present invention.

FIG. 3 depicts an embodiment of paper of the present invention showing pulp web 16 with plurality of crossdirectional regions 11 of increased basis weight. FIG. 4 depicts an embodiment of a smoking article of the present invention incorporating an embodiment of paper of the present invention which contains plurality of crossdirectional regions 11 of increased basis weight.

It will be apparent that the foregoing is merely illustrative of the principles of this invention, and that various modifications can be made by those skilled in the art without departing from the scope and spirit of the invention. For example, although succinate and citrate have been mentioned as possible burn control chemicals, other conventional burn control chemicals can be used if desired. Furthermore, one, some, or all of the components of the papermaking machine as described above may be rotated or translated to create a different configuration of the machine.

EXAMPLE 1

A slurry of refined hardwood is applied to a base web on a 12" wide pilot paper machine operating at 40 fpm. The base web is 40 g/m$^2$ composed of flax fibers with 30% precipitated calcium carbonate (surface area: 22 m$^2$/g) at 40 Coresta porosity and the crossdirectional regions have an additional 10 g/m$^2$ band application. The slurry is composed of hardwood pulp that has been prepared by refining 360 g of bleached hardwood pulp at 1.4% consistency in a standard TAPPI Valley beater for 24 Hr. The slurry is applied at 0.75% consistency on to base web in bands 5 mm wide spaced 21 mm center to center. The thickness of the base web is 2.5 mils, whereas the banded region is 2.7 mils. The application device is depicted in FIG. 2. The sheet is dried, rewet and dried to remove wrinkles, sized with 0.9% sodium/potassium citrate and used to wrap a tobacco column. Cigarettes machine-made from this paper extinguished during static burn in 30 to 120 seconds after the burn line reached the first band.

EXAMPLE 2

A slurry of Cellulon (Weyerhaeuser's high surface area biologically created cellulose) is applied to a flax base web of 35 g/m$^2$ with 30% calcium carbonate (surface area: 8 g/m$^2$) at 40 Coresta porosity and the crossdirectional regions have an additional 1 g/m$^2$ band application. The slurry is applied at 0.04% consistency on to base web in bands 5 mm wide spaced 21 mm center to center. The application device is a plastic template placed on top of a wet handsheet in a handsheet mold. The slurry is pumped on top of the template and applied on to the base web through slots cut into the template. The thickness of the base web is 2.6 mils, whereas the banded region is 2.8 mils. The handsheet is dried, sized with 0.9% sodium/potassium citrate and used to wrap a tobacco column. Cigarettes hand-made from this paper extinguished during static burn in 30 to 120 seconds.

EXAMPLE 3

A slurry of the experimental expanded fiber produced by Proctor and Gamble Corporation (Buckeye), a highly refined and fibrillated cellulose made using mechanical abrasion, is applied to a flax base web of 35 g/m$^2$ with 30% calcium carbonate (surface area: 8 g/m$^2$) at 40 Coresta porosity and crossdirectional regions have an additional 5 g/m$^2$ band application. The same method of application used in Example 2 is used in Example 3. The thickness of this sheet's base web is 2.9 mils, whereas the banded region is 3.2 mils. The handsheet is dried, sized with 0.9% sodium/potassium citrate and used to wrap a tobacco column. Cigarettes hand-made from this paper extinguished during static burn in 30–120 seconds.

We claim:

1. A nonlaminated cigarette paper comprising a base web portion and a plurality of crossdirectional regions, said base web portion having a basis weight in the range of approximately 25 to 70 grams per meter squared, said crossdirectional regions having a basis weight from 0.01% to about 30% above the basis weight of the base web portion, the crossdirectional regions having a porosity of up to about 10 Coresta, said porosity of said crossdirectional regions being less than a porosity of the base web portion such that a burn rate of a cigarette that incorporates said cigarette paper is less at said crossdirectional regions than at said base web portion.

2. The nonlaminated cigarette paper of claim 4, wherein said base web comprises cellulosic fiber.

3. The cigarette paper of claim 1 in which each crossdirectional region extends completely across said nonlaminated cigarette paper.

4. The nonlaminated cigarette paper of claim 1, wherein each crossdirectional region is divided into a plurality of separate sections which are non-contiguous in the crossdirection.

5. The paper of claim 1, wherein the crossdirectional regions have a width of about 1 mm to about 10 mm.

6. The paper of claim 1, wherein the crossdirectional regions have a width of about 1.5 mm to about 5 mm.

7. The paper of claim 1, wherein the crossdirectional regions have a width of about 5 mm.

8. The paper of claim 1, wherein the crossdirectional regions are positioned about 5 mm to about 40 mm apart.

9. The nonlaminated cigarette paper of claim 8, wherein the crossdirectional regions have a thickness of no more than 10% greater than the thickness of the base web.

10. The nonlaminated cigarette paper of claim 4, wherein the crossdirectional regions are spaced about 15 mm to about 30 mm apart.

11. The nonlaminated cigarette paper of claim 4, wherein the crossdirectional regions are positioned about 21 mm apart.

12. The nonlaminated cigarette paper of claim 4, wherein the crossdirectional region has a thickness of no more than 10% greater than the thickness of the base web portion.

13. The nonlaminated cigarette paper of claim 12, in which each crossdirectional region extends completely across nonlaminated cigarette paper.

14. The nonlaminated paper of claim 13, wherein each crossdirectional region is divided into a plurality of separate sections which are non-contiguous in the crossdirection.

15. The nonlaminated paper of claim 12, wherein the crossdirectional regions have a width of about 1 mm to about 10 mm.

16. The nonlaminated paper of claim 12, wherein the crossdirectional regions have a width of about 1.5 mm to about 5 mm.

17. The nonlaminated paper of claim 12, wherein the crossdirectional regions have a width of about 5 mm.

18. The nonlaminated paper of claim 12, wherein the crossdirectional regions are positioned about 5 mm to about 40 mm apart.

19. The nonlaminated cigarette paper of claim 1, wherein the crossdirectional regions are positioned about 21 mm apart and have a thickness of no more than, 10% greater than the thickness of the base web portion.

20. The cigarette paper of claim 1, wherein said crossdirectional regions comprise base web material and an additional material, said additional material including a filler.

21. The cigarette paper of claim 4, wherein said crossdirectional regions are formed by additional material added to a pulp web in a paper making machine.

22. The paper of claim 21, wherein said additional material is selected from the group consisting of refined pulp, high surface area cellulosic fibers, micro-crystalline cellulose and a mixture of highly refined pulp and calcium carbonate.

23. A nonlaminated cigarette paper comprising a base web portion and a plurality of crossdirectional regions, said crossdirectional regions having a basis weight from 0.01% to about 30% above a basis weight of the base web portion and a porosity less than the porosity of the base web portion, such that a burn rate of a cigarette that incorporates said cigarette paper is less at said crossdirectional regions than at said base web portion;

wherein the base web portion has a porosity of about 25 to about 60 Coresta and the crossdirectional regions have a porosity of up to about 10 Coresta.

24. The cigarette paper of claim 23, wherein said crossdirectional regions include a material additional to said base web portion, said additional material being selected from the group consisting of refined pulp, high surface area cellulosic fibers, micro-crystalline cellulose and a mixture of highly refined pulp and calcium carbonate.

25. A smoking article comprising a tobacco rod overwrapped with a nonlaminated cigarette paper, said cigarette paper comprising a base web portion of cellulosic fiber and a plurality of crossdirectional regions of increased basis weight and decreased porosity, wherein the basis weight of said crossdirectional regions is about 0.01% to about 30% above the basis weight of said base web portion, said crossdirectional regions having a static burn rate less than said base web portion.

26. The smoking article of claim 25, wherein the cross directional regions have a width of about 1 mm to about 10 mm.

27. The smoking article of claim 26, wherein the crossdirectional region has a thickness of no more than 10% greater than the thickness of the base web.

28. The smoking article of claim 25, wherein the cross directional regions have a width of about 3 mm to about 7 mm.

29. The smoking article of claim 28, wherein the cross-directional region has a thickness of no more than 10% greater than the thickness of the base web.

30. The smoking article of claim 25, wherein the cross directional regions have a width of about 2.5 mm.

31. The smoking article of claim 30, wherein the cross-directional region has a thickness of no more than 10% greater than the thickness of the base web.

32. The smoking article of claim 25, wherein the cross-directional regions are spaced about 15 mm to about 30 mm apart.

33. The smoking article of claim 32, wherein the cross-directional region has a thickness of no more than 10% greater than the thickness of the base web.

34. The smoking article of claim 22, wherein the cross-directional regions are positioned about 21 mm apart.

35. The smoking article of claim 34, wherein the cross-directional region has a thickness of no more than 10% greater than the thickness of the base web.

36. The smoking article of claim 25, wherein the base web portion has a porosity of about 25 to about 60 Coresta and the crossdirectional regions have a porosity of up to about 10 Coresta.

37. The smoking article of claim 36, wherein the cross-directional region has a thickness of no more than 10% greater than the thickness of the base web.

38. The smoking article of claim 25, wherein the cross-directional region has a thickness of no more than 10% greater than the thickness of the base web.

39. The smoking article of claim 25, wherein said cross-directional regions comprise base web material and an additional material, said additional material including a filler.

40. The smoking article of claim 25, wherein said cross-directional regions include a material additional to said base web portion, said additional material being selected from the group consisting of refined pulp, high surface area cellulosic fibers, micro-crystalline cellulose and a mixture of highly refined pulp and calcium carbonate.

41. A nonlaminated cigarette paper comprising a base web portion and a plurality of crossdirectional regions having a basis weight from 0.01% to about 30% above a basis weight of the base web portion and a porosity less than the porosity of the base web portion, wherein the base web portion has a porosity of about 25 to about 60 Coresta and the crossdirectional regions have a porosity of up to about 10 Coresta, and wherein the crossdirectional region has a thickness of no more than 10% greater than the thickness of the base web portion.

42. The cigarette paper of claim 41, wherein said cross-directional regions comprise base web material and an additional material, said additional material including a filler.

* * * * *